United States Patent [19]

Purdy

[11] 4,021,942

[45] May 10, 1977

[54] SNOW HANDLING AND CONDITIONING APPARATUS

[76] Inventor: Floyd E. Purdy, 1747 Clark Lake, Brighton, Mich. 48116

[22] Filed: July 26, 1976

[21] Appl. No.: 708,887

[52] U.S. Cl. ..... 37/10; 172/145; 172/150; 172/188; 172/192; 172/391; 172/393

[51] Int. Cl.[2] ..... E01H 4/00; A01B 5/00

[58] Field of Search ..... 37/10, 117.5, 43, 126 AD, 37/DIG. 3; 172/66, 133, 146, 145, 150, 188, 192, 197–200, 360, 785, 140, 143, 149

[56] References Cited

UNITED STATES PATENTS

| | | | |
|---|---|---|---|
| 1,706,257 | 3/1929 | Ronning et al. | 172/146 X |
| 1,854,368 | 4/1932 | Davis et al. | 172/785 |
| 2,786,283 | 3/1957 | Bradley | 37/10 |
| 2,840,933 | 1/1958 | Brem | 37/117.5 |
| 2,880,528 | 4/1959 | Lusk | 172/199 |
| 3,319,366 | 5/1967 | Thompson | 37/117.5 |
| 3,409,088 | 11/1968 | Lindbeck et al. | 172/66 |
| 3,783,949 | 1/1974 | Maxey | 172/133 |
| 3,794,122 | 2/1974 | Rohrer | 172/146 X |
| 3,876,013 | 4/1975 | Dunn | 172/150 X |
| 3,878,900 | 4/1975 | Boisse et al. | 172/145 |

FOREIGN PATENTS OR APPLICATIONS

| | | | |
|---|---|---|---|
| 113,644 | 8/1941 | Australia | 172/393 |
| 275,774 | 8/1927 | United Kingdom | 172/393 |
| 773,163 | 4/1957 | United Kingdom | 37/43 |

*Primary Examiner*—E. H. Eickholt
*Attorney, Agent, or Firm*—Olsen and Stephenson

[57] ABSTRACT

Apparatus for towing behind a tow vehicle to handle and condition snow on ski slopes, including a ripper assembly having teeth for ripping the surface of the snow, a scraper assembly for scraping the surface of the snow and to redeposit quantities of accumulated snow in low areas, a roller assembly for compacting loose snow and a drag assembly for dragging the surface of conditioned snow.

11 Claims, 10 Drawing Figures

SNOW HANDLING AND CONDITIONING APPARATUS

BACKGROUND OF THE INVENTION

The present invention relates to improvements in apparatus for handling and conditioning snow at winter recreation areas.

It is conventional practice to condition snow on hills or ski slopes for recreational purposes, but the equipment now available for this purpose does not serve to provide the desired and necessary grooming of the snow without expending considerable time and effort, and even then the results realized often are not fully satisfactory for ideal skiing or other recreational activities.

SUMMARY OF THE INVENTION

The present invention has overcome the inadequacies of the prior art and provides improved apparatus of the foregoing character which enables a single operator to handle and condition snow to meet requirements for most satisfactory skiing conditions, and to accomplish this result in a minimal time so that ski slopes can be made ready and kept available to skiers at times most favorable for recreational purposes.

According to one form of the present invention, snow handling and conditioning apparatus is provided which attaches to and is pulled by a towing vehicle. The apparatus comprises a tongue assembly including a tongue for attachment to the towing vehicle and a transverse crossbar connected at its midpoint to the tongue. A ripper assembly is provided which includes a transverse ripper frame having shoes on its outer sides for travel on snow and ripper teeth supported between the shoes so that their ends can project below the lower surfaces of the shoes for penetration of the snow. A pair of ripper pivot couplings are connected at their forward ends to the crossbar for pivotal movement in fore-and-aft vertical planes and are connected at their rearward ends to the ripper frame by limited yieldable joints. One ripper pivot coupling is connected to the crossbar between the midpoint thereof and one of its ends, and the other ripper pivot coupling is connected to the crossbar between the midpoint and the other of its ends. A support means for travel on the snow is positioned to the rear of the crossbar and is connected to the outer ends thereof for maintaining the crossbar in an elevated position when the apparatus is being towed. A ripper actuating means is connected between the support means and the transverse ripper frame for selectively raising and lowering the transverse ripper frame desired amounts relative to the support means and thereby relative to the surface of the snow. Preferably, the ripper actuating means is a hydraulic cylinder which can be controlled from the towing vehicle so that the operator can readily raise and lower the ripper teeth. The ripper actuating means or hydraulic cylinder is connected to the transverse ripper frame midway between the shoes so that the transverse ripper frame can tilt to follow the contours of the surface of the snow.

The support means for the ripper assembly includes a roller for traveling on the surface of the snow to aid in grooming it and frame means supported at the rear by the roller and connected at the front to the ends of the crossbar. The ripper actuating means or hydraulic cylinder is connected between the forward portion of the frame means and the transverse ripper frame.

The frame means includes a scraper frame and a roller frame rearwardly thereof and pivotally connected to the scraper frame for raising and lowering the forward end of the scraper frame. The scraper frame has a scraper blade for scraping snow when the scraper frame is in a lowered position, and a scraper actuating means, such as hydraulic cylinders, are connected between the scraper frame and the roller frame for moving the scraper frame to selected positions with respect to the snow surface. A hopper or container means is positioned on the scraper frame adjacent to the scraper blade to accumulate snow scraped by the scraper blade. The container means is open at the bottom so that snow accumulated therein can be dispensed therefrom either in response to the scraper blade being raised above the snow surface or when the container means passes over a low area in the snow. By virtue of this arrangement, snow can readily be filled into low spots on the slope to provide a more uniform surface for skiing .

A drag assembly is mounted on the aforesaid support means and includes at least one drag member adapted to be dragged at the rear of the support means on the surface of the snow, and drag actuating means are provided for raising and lowering the drag member. In the preferred embodiment, a plurality of drag members are utilized to finish conditioning or grooming the snow in a desired manner after it has been compacted or rolled smooth by the roller of the roller assembly.

By virtue of the control means asociated with the various assemblies that are interconnected and form the snow handling and conditioning apparatus, the operator of the tow vehicle can completely condition the snow surface for ideal skiing or other winter recreational purposes, merely by making a single pass of the towing vehicle across the surface of the snow to be conditioned. The apparatus can readily be controlled so that any of the assemblies can be taken out of service or placed into service at the option of the operator.

Thus, it is an object of the present invention to provide improved apparatus for grooming snow.

Other objects of this invention will appear in the following description and appended claims, reference being had to the accompanying drawings forming a part of this specification wherein like reference characters designate corresponding parts of the several views.

DESCRIPTION OF THE PREFERRED EMBODIMENT

Figures 1, 2:
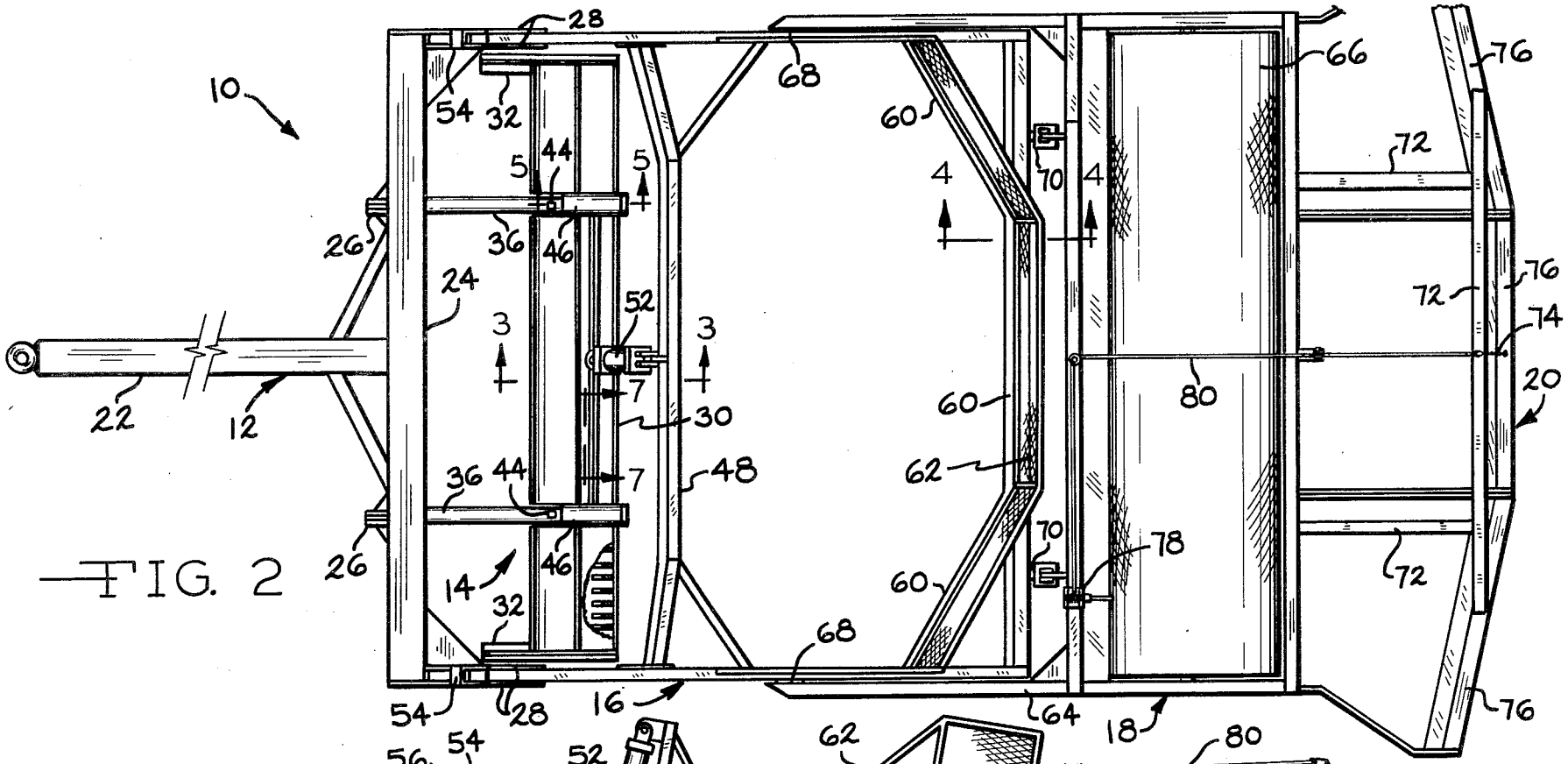
FIG.1 is a side elevational view of snow handling and conditioning apparatus embodying the present invention.
FIG. 2 is a top plan view of the snow handling and conditioning apparatus.
Figure 5:
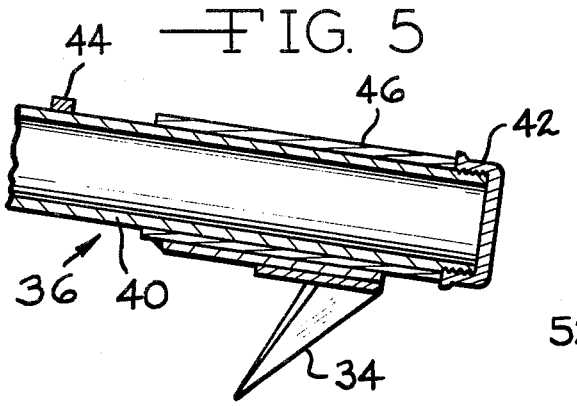
FIG. 5 is an enlarged fragmentary section taken on the lines 5—5 of FIG. 2 showing details of the limited yieldable joint of one of the ripper pivot couplings.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The snow handling and conditioning apparatus 10 includes a tongue assembly 12, a ripper assembly 14, a scraper assembly 16, a roller assembly 18 and a drag assembly 20. The assemblies are arranged in series so that the operator of the tow vehicle can groom the snow with each of these assemblies in a single pass over the snow. At his option, he can place the ripper assembly, the scrapper assembly or the drag assembly out of service during any pass over an area of snow.

The tongue assembly 12 includes the tongue 22 which is rigidly connected to the crossbar 24 at the midpoint or midway between the ends thereof. Brackets 26 are secured to the crossbar 24 substantially halfway between its connection with the tongue 22 and its opposite ends. Each of the ends of the crossbar 24 has a rearwardly extending fork 28 for pivotal connection with the scraper assembly 16. The brackets 26 are provided for use in connecting the ripper assembly 14 to the crossbar 24.

Figure 3:
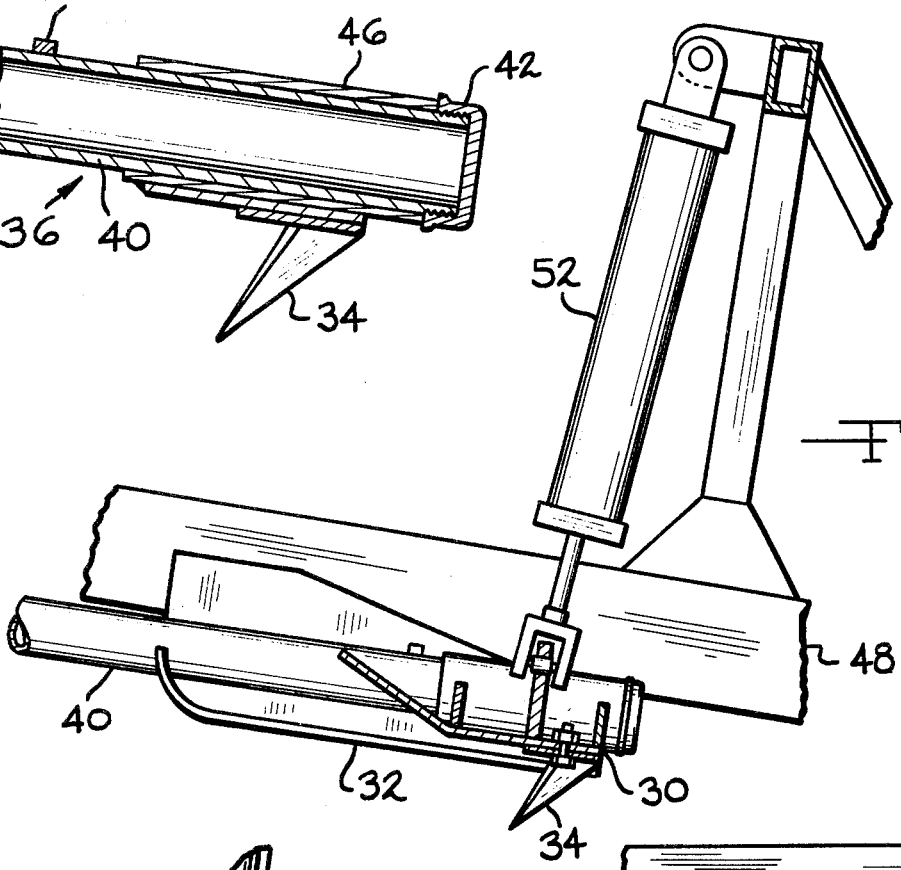
FIG. 3 is an enlarged fragmentary section taken on lines 3—3 of FIG. 2 showing details of the ripper assembly and ripper actuating means.
Figure 7:
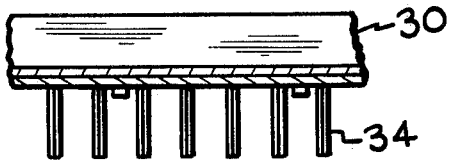
FIG. 7 is an enlarged fragmentary section taken on the lines 7—7 of FIG. 2 showing details of the ripper teeth.
Figure 4:
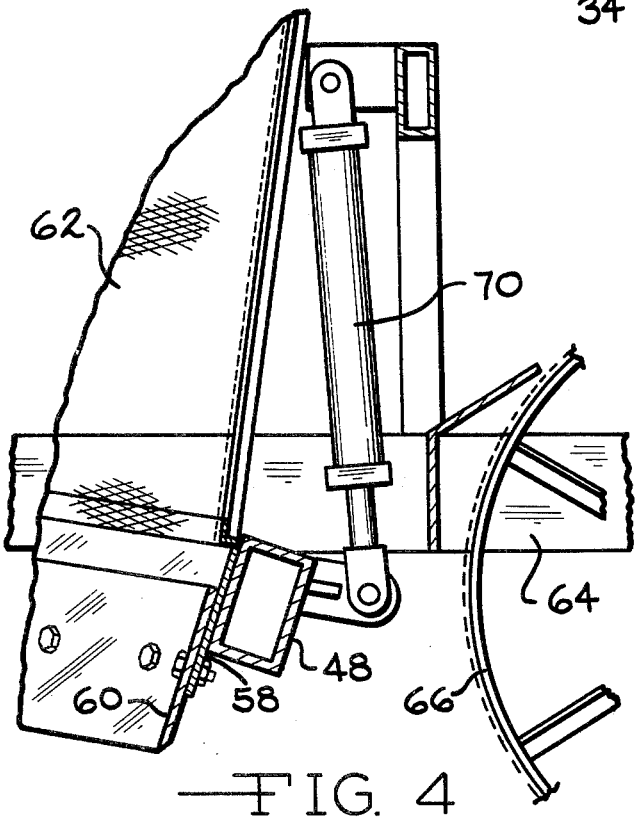
FIG. 4 is an enlarged fragmentary section taken on the lines 4—4 of FIG. 2 showing details of the scraper actuating means.
Figure 6:
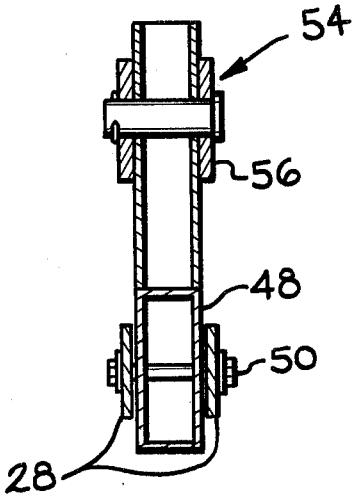
FIG. 6 is an enlarged fragmentary section taken on the lines 6—6 of FIG. 1 showing the joint between the tongue asembly crossbar and the scraper frame attached thereto.

The ripper assembly 14 includes the transverse ripper frame 30 on the opposite ends of which are mounted the shoes 32, adapted to travel on the surface of snow. As can be seen best in FIG. 3, ripper teeth 34 are supported on the ripper frame 30 between the shoes 32 so that the ends of the teeth project below the lower surfaces of the shoes 32 for penetrating into snow.

The ripper frame 32 is connected to the crossbar 24 by the pair of ripper pivot couplings 36. The pivot couplings 36 are connected respectively by pins 38 to the brackets 26 of the crossbar as can be seen in FIG. 1. Each ripper pivot coupling has a tubular portion 40 which is connected to the bracket 26 by the pin 38, and it has a cap 42 threadedly connected to its rear end and a fixed limit stop 44 spaced forward therefrom. Slidably fitted on the tube is the sleeve 46 which is rigidly connected to the ripper frame 30. Thus, limited yieldable movement is provided at the joint between the ripper frame 30 and each of the ripper pivot couplings 36, which will allow the ripper frame to move forward and rearward a limited distance with respect to each of the tubular portions 40 of the couplings 36. This feature allows the ripper assembly to float freely to a limited extent and thereby to accommodate irregularities in the terrain over which the snow handling and conditioning apparatus is being towed.

The scraper assembly 16 includes a rigid scraper frame 48 which is pivotally connected at its forward end by the pins 50 to the forked ends of the drawbar 24. Ripper actuating means in the form of a hydraulic cylinder 52 is hingedly connected between the rigid scraper frame 48 and the ripper frame 30 for raising and lowering the latter with respect to the former. By virtue of this arrangement, the operator of the tow vehicle can readily raise and lower the ripper frame 30 to raise the shoes 32 and ripper teeth 34 above the surface of the snow or he can lower the frame 30 so that the shoes 32 travel on the surface of the snow and the ripper teeth 34 then penetrate the snow to rip the surface thereof.

Figures 8, 9, 10:
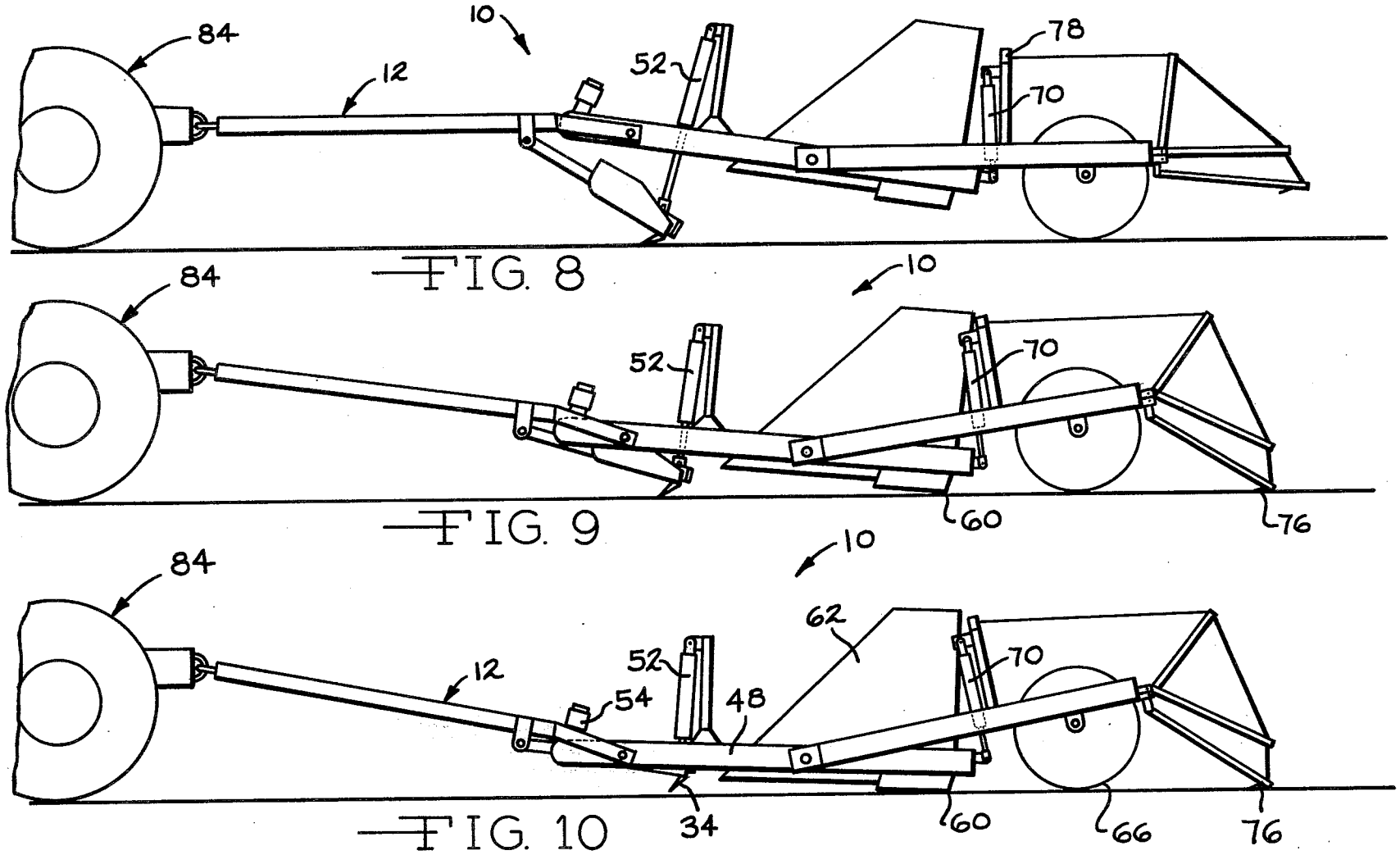
FIGS. 8, 9 and 10 are schematic illustrations of the snow handling and conditioning apparatus in different positions of operation.

When it is desired to travel with the ripper frame 30 in an elevated position, it is necessary that the extent of pivotal movement between the scraper frame 48 and the tongue assembly 12 be limited, and for this purpose, limit stop members 54 are provided in the form of enlarged sleeves 56 which have a width greater than the spacing between the forked ends 28 of the crossbar 24 so that the limit stop members 54 will restrict pivotal movement to the extent shown in FIG. 10 between the scraper frame 48 and the tongue assembly 12.

The rear of the scraper frame 48 has integrally secured thereto scraper plates 58 to which replaceable scraper blades 60 are attached. By virtue of this construction and arrangement, lowering of the rear end of the scraper frame 48 will result in the scraper blades 60 scraping the surface of the snow, and the snow thus scraped can be accumulated within the confines of the scraper frame 40 to the extent permitted by the container means or hopper 62. Thereafter, the snow accumulated can be dispensed onto other areas merely by raising the rear end of the scraper frame 48, or by gravity, if passage occurs over a low spot.

The roller assembly 18 includes the roller frame 64 which is supported on the roller 66 and is pivotally connected at its forward end to the scraper frame 48 by the pins 68 which extend into the scraper frame 48. The extent of pivotal movement between the roller frame 64 and the scraper frame 48 is determined by the position of the scraper actuating means or hydraulic cylinders 70 which are pivotally connected at their opposite ends to these two frames. Thus, when it is desired to tow the snow handling and conditioning apparatus 10 with the scraper assembly in its elevated position, the hydraulic cylinders 70 will be actuated to the retracted positions shown in FIG. 1. When in this position, the frames 48 and 64 and the roller 66 constitute support means for travel on the snow at the rear of the crossbar 24 for maintaining the crossbar 24 in an elevated position. The roller 66 has a suitable mesh surface so that it can roll properly on the surface of the snow without sidewise slippage and so as to suitably compact or groom the surface of the snow.

The drag assembly 20 includes the drag frame 72 which is pivotally connected at its forward ends to the roller frame 64 and has a plurality of chains 74 at its rear end 70. Suspended by the chains are the drag members 76 which are pivotally connected at their forward ends to the roller frame 64. Thus, the drag members 76 can be dragged freely on the surface of the snow after it has been conditioned or groomed by the several assemblies preceding it in the snow handling and conditioning apparatus. For the purpose of lowering the drag members 76 to the surface of the snow, a winch 78 and winch cable 80 are provided, the winch cable 80 passing over the pivotally connected pivot bar 82 and being connected at the end to the pivotally supported drag frame 72. As shown best in FIGS. 9 and 10, the drag members 76 can readily be lowered to the snow or supporting surface merely by unwinding the winch cable from the winch 78.

FIGS. 8, 9 and 10 show the snow handling and conditioning apparatus 10 attached to a towing vehicle or tractor 84. In FIG. 8, the actuating means or hydraulic cylinder 52 is shown in a fully extended position, the actuating means or hydraulic cylinder 70 is shown in a fully retracted position, and the actuating means or winch 78 is shown in a retracted position. In FIG. 9, the hydraulic cylinder 52 is partly retracted and the hydraulic cylinders 70 are partly extended to permit scraping by the blades 60, and the drag assembly is lowered to a position to make appropriate dragging of the conditioned snow by the drag members 76. In FIG. 10, the cylinder 52 has been retracted so that the ripper teeth 34 are elevated above the surface of the snow, but the scraper blades 60 and drag members 76 are still in their lowered or snow engaging positions. However, it will be recognized that snow can be dispensed from the hopper 62 merely by fully contracting the hydraulic cylinder 70 so that the snow can be dispensed under the scraper blade 60.

It will also be understood that any variety of arrangements can be said to enable the operator of the tractor 84 to perform various conditioning operations on the surface of the snow with the apparatus described above. For the purpose of actuating the hydraulic cylinders, conventional hydraulic couplings and hydraulic hoses (not shown) are provided from the tractor 84 to suitable fittings (not shown) located on the snow handling and conditioning apparatus 10.

It is claimed:

1. Snow handling and conditioning apparatus comprising a tongue assembly including a tongue for attachment to a tow vehicle and a transverse crossbar connected at its midpoint to said tongue, a ripper assembly including a transverse ripper frame having shoes on its outer sides for travel on snow and ripper teeth supported between said shoes so that their ends can project below the lower surfaces of said shoes for penetrating into said snow, a pair of ripper pivot couplings connected at forward ends to said crossbar for pivotal movement in fore-and-aft vertical planes and connected at rearward ends to said ripper frame by limited yieldable joints, one ripper pivot coupling being connected to said crossbar between said midpoint and one of its ends and the other ripper pivot coupling being connected to said crossbar between said midpoint and the other of its ends, support means for travel on snow positioned to the rear of said crossbar and connected to the ends thereof for maintaining the crossbar in an elevated position when said apparatus is being towed, and ripper actuating means connected between said support means and said transverse ripper frame for selectively raising and lowering said transverse ripper frame desired amounts relative to said support means and thereby relative to the surface of the snow.

2. The snow handling and conditioning apparatus that is defined in claim 1, wherein said actuating means has a single connection to said transverse ripper frame midway between said shoes so that said transverse ripper frame can tilt to follow contours of the surface of the snow.

3. The snow handling and conditioning apparatus that is defined in claim 1, wherein said support means includes a roller for traveling on the surface of the snow and frame means supported at the rear by said roller and connected at the front to the ends of said crossbar, said ripper actuating means including a hydraulic cylinder connected between a forward portion of said frame means and said transverse ripper frame.

4. The snow handling and conditioning apparatus that is defined in claim 3, wherein said frame means includes a scraper frame and a roller frame rearwardly thereof and pivotally connected to the scraper frame for raising and lowering the rearward end of the scraper frame, said scraper frame having a scraper blade for scraping snow when the scraper frame is in a lowered position, and a scraper actuating means connected between said scraper frame and said roller frame for moving said scraper frame relative to the roller frame to selected positions of the scraper blade with respect to the snow surface.

5. The snow handling and conditioning apparatus that is defined in claim 4, wherein a container means is mounted on said scraper frame to accumulate snow scraped by said scraper blade.

6. The snow handling and conditioning apparatus that is defined in claim 5, wherein said container means is open at the bottom so that snow accumulated therein can be dispensed therefrom in response to said scraper blade being raised above the snow surface.

7. The snow handling and conditioning apparatus that is defined in claim 1, wherein said support means and said ends of the cross bar are hingedly connected together for relative movement about a horizontal axis, and limit stop members are operably disposed adjacent to the hinged connections to limit the extent that the hingedly connected components can be lowered.

8. The snow handling and conditioning apparatus that is defined in claim 1, wherein a drag assembly is mounted on said support means and inlcudes at least one drag member for being dragged to the rear of the support means on the surface of the snow, and drag actuating means for raising and lowering said drag member.

9. The snow handling and conditioning apparatus that is defined in claim 8, wherein said drag assembly includes a drag frame pivotally connected to the rear of said support means for being raised and lowered, said drag member being suspended below said drag frame, and said drag actuating means includes a winch and winch cable connected for positioning said drag frame at a selected height.

10. Snow handling and conditioning apparatus comprising:

a tongue assembly including a tongue for attachment to a tow vehicle and a crossbar connected to said tongue, a ripper assembly pivotally connected at its forward end to said crossbar to be pulled by the latter, said ripper assembly including at its rearward end a transverse ripper frame having shoes on outer sides and ripper teeth supported between said shoes and having their ends projected below the lower surfaces of said shoes, a scraper assembly pivotally connected at its forward end to said crossbar to be pulled by the latter, said scraper assembly including a scraper frame extending rearward of said ripper frame and having a transverse scraper blade located rearward of said ripper teeth and extending downward as a lower extremity of the scraper frame, and a hopper for receiving material scraped by said blade, a roller assembly connected to said scraper assembly to be pulled by the latter, said scraper assembly including a roller frame pivotally connected at its forward end to said scraper frame at a location forward of said scraper blade, and a roller extending transversely of said roller frame and on which the rearward end of said roller frame is supported, and actuating means positioned between adjacent ones of said ripper, scraper and roller assemblies for securing adjacent ones of said assemblies in selected positions of elevation relative to one another, said actuating means including a ripper actuating means positioned midway between opposite sides of said ripper assembly so that said ripper frame can tilt and said shoes can follow on the contour of the snow that is being conditioned, and scraper actuating means positioned between the rearward end of said scraper frame and longitudinally intermediate portion of said roller frame so that said scraper blade can be moved vertically relative to said roller frame.

11. The snow handling and conditioning apparatus that is defined in claim 10, which includes a drag assembly connected to said roller assembly to be pulled by the latter, said drag assembly having a drag frame and at least one drag member supported in transverse position below said drag frame.

* * * * *